US007757511B2

(12) United States Patent
LeClear et al.

(10) Patent No.: US 7,757,511 B2
(45) Date of Patent: Jul. 20, 2010

(54) REFRIGERATED DRAWER HAVING AN ICEMAKER

(75) Inventors: Douglas D. LeClear, Coloma, MI (US); Jim J. Pastryk, Sawyer, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 145 days.

(21) Appl. No.: 11/937,866

(22) Filed: Nov. 9, 2007

(65) Prior Publication Data

US 2008/0156022 A1 Jul. 3, 2008

Related U.S. Application Data

(60) Provisional application No. 60/877,669, filed on Dec. 29, 2006.

(51) Int. Cl.
*F25C 1/22* (2006.01)
*A47B 96/04* (2006.01)

(52) U.S. Cl. ..... 62/340; 312/404; 312/402

(58) Field of Classification Search ..... 62/340, 62/302, 345, 382; 361/404, 348.3
See application file for complete search history.

(56) References Cited

U.S. PATENT DOCUMENTS

| | | | | |
|---|---|---|---|---|
| 2,435,102 | A | 1/1948 | Rundell | |
| 2,799,144 | A | 7/1957 | Barton | |
| 2,857,748 | A | 10/1958 | Nelson | |
| 2,941,379 | A | 6/1960 | Nelson | |
| 3,788,089 | A | 1/1974 | Graves | |
| 5,329,786 | A | 7/1994 | Willis et al. | |
| 6,253,568 | B1 * | 7/2001 | Peffley | 62/441 |
| 6,286,331 | B1 | 9/2001 | Lee | |
| 7,017,354 | B2 | 3/2006 | Lee et al. | |
| 2003/0154736 | A1 * | 8/2003 | Lloyd et al. | 62/291 |
| 2004/0045311 | A1 * | 3/2004 | Bonato et al. | 62/354 |
| 2004/0183415 | A1 | 9/2004 | Kim | |
| 2005/0061009 | A1 | 3/2005 | Flinner et al. | |
| 2005/0115266 | A1 | 6/2005 | Lim et al. | |
| 2005/0236946 | A1 | 10/2005 | LeClear et al. | |
| 2005/0236947 | A1 * | 10/2005 | LeClear et al. | 312/404 |
| 2005/0257536 | A1 | 11/2005 | Chung et al. | |
| 2006/0086132 | A1 | 4/2006 | Maglinger et al. | |
| 2006/0152119 | A1 | 7/2006 | Park | |
| 2007/0151281 | A1 * | 7/2007 | Jackovin | 62/344 |

FOREIGN PATENT DOCUMENTS

| | | |
|---|---|---|
| JP | 11183000 | 7/1999 |

* cited by examiner

*Primary Examiner*—Frantz F. Jules
*Assistant Examiner*—Cassey Bauer
(74) *Attorney, Agent, or Firm*—Kirk W. Goodwin; Diederiks & Whitelaw, PLC

(57) ABSTRACT

A refrigerated appliance includes a cabinet including a drawer and a refrigeration system having at least a compressor, a condenser and an evaporator. An icemaker unit is mounted in the drawer and includes a housing and an ice cube mold. The evaporator includes a coil mounted below the housing proximate to the ice cube mold. A mounting plate is attached to the housing with the evaporator coil sandwiched therebetween. With this arrangement, the evaporator coil is selectively operated to provide freezing temperatures to form ice cubes in the ice cube mold and establish refrigerated temperatures in the refrigerated compartment. That is, the refrigeration system is selectively operated to chill the evaporator in both an ice production mode and a refrigeration mode.

13 Claims, 4 Drawing Sheets

REFRIGERATED DRAWER HAVING AN ICEMAKER

CROSS-REFERENCE TO RELATED APPLICATION

The present application claims the benefit of U.S. Provisional Patent Application Ser. No. 60/877,669 filed Dec. 29, 2006 entitled "Refrigerated Drawer Having an Icemaker."

BACKGROUND OF THE INVENTION

1. Field of the Invention

The present invention pertains to the art of refrigerated appliances and, more particularly, to a refrigerated drawer including an icemaker that establishes a refrigerated environment for the drawer.

2. Description of the Related Art

Refrigerated appliances are available in a variety of models. A typical household will include a top mount, bottom mount, side-by-side or French-style model refrigerator. Each of the above listed models includes a freezer compartment and a fresh food compartment. A refrigeration system is employed to establish a refrigerated temperature below 32° F. (0° C.) in the freezer compartment. In many cases, freezing air is guided from the freezer into the fresh food compartment to establish a refrigerated temperature above 32° F. (0° C.). In this manner, a single refrigeration system can be employed to regulate the temperatures in multiple refrigerated compartments. Of course, there also exist refrigerator models that employ dedicated refrigeration systems for each of the freezer and fresh food compartments, as well as models that simply include a single system employed in connection with a stand-alone freezer and/or fresh food refrigerator.

While larger refrigerators are more popular, smaller units are currently gaining acceptance among consumers. Many urban dwellers live in small apartments or condominiums that have smaller kitchens. In order to maximize living space, larger refrigerators are being replaced by smaller refrigerated drawer units. A similar trend can even be seen in connection with modern kitchens where appliances are being designed to mimic adjacent cabinetry for aesthetic and other purposes. This new design provides the consumer with flexibility to choose from a variety of different refrigerated drawer styles and configurations, such as fresh food drawers and wine storage drawers, depending upon particular needs and personal taste.

In most cases, a refrigerated drawer unit will include multiple drawers that take the place of kitchen cabinets, often with the drawers being arranged under existing countertops. At least one of the drawers must be able to accommodate a refrigeration system that establishes a suitable refrigerated environment for the drawers. A basic refrigeration system includes a compressor, condenser, evaporator coil and fan. The fan directs air across the evaporator coil and into each drawer to establish a temperature above 32° F. (0° C.). Although refrigerated, fresh food drawers are becoming more widely accepted, freezer drawers have not been as commonplace, particularly freezer drawers with icemaking systems.

Based on the above, there exists a need for a refrigerated drawer that can be maintained at freezing temperatures. More specifically, there exists a need for a refrigerated drawer that includes an icemaking system having an associated evaporator unit that is selectively operated to not only form ice cubes but establish a refrigerated environment in the refrigerated drawer.

SUMMARY OF THE INVENTION

The present invention is directed to a refrigerated appliance including a cabinet within which is shiftably mounted a drawer having front, rear, bottom and opposing side walls that collectively define a refrigerated compartment. A refrigeration system including a compressor, a condenser and an evaporator is selectively operated to establish a refrigerated temperature in the refrigeration compartment. An icemaker unit, having a housing and an ice cube mold mounted to one of the front, rear and opposing side walls, is provided in the drawer for producing ice cubes.

In accordance with the invention, the evaporator of the refrigeration system is mounted below the icemaker housing, proximate to the ice cube mold. Preferably, a mounting plate is attached to the housing, with the evaporator taking the form of a coil being sandwiched between the housing and the mounting plate. With this arrangement, the evaporator coil is employed in establishing both freezing temperatures to form ice cubes in the ice cube mold and also establish refrigerated temperatures in the refrigerated compartment. That is, the refrigeration system is operable to both chill the evaporator in both an ice production mode and a refrigeration mode.

In accordance with a preferred embodiment of the invention, the evaporator coil is secured to the mounting plate which, in turn, is fastened to the housing directly adjacent the ice mold. Preferably, the evaporator coil is snap-fittingly received in a channel formed in the mounting plate. Most preferably, the evaporator coil is arranged in a serpentine configuration and is snap-fittingly received in at least two channels formed in the mounting plate.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF PREFERRED EMBODIMENTS

Figure 1:
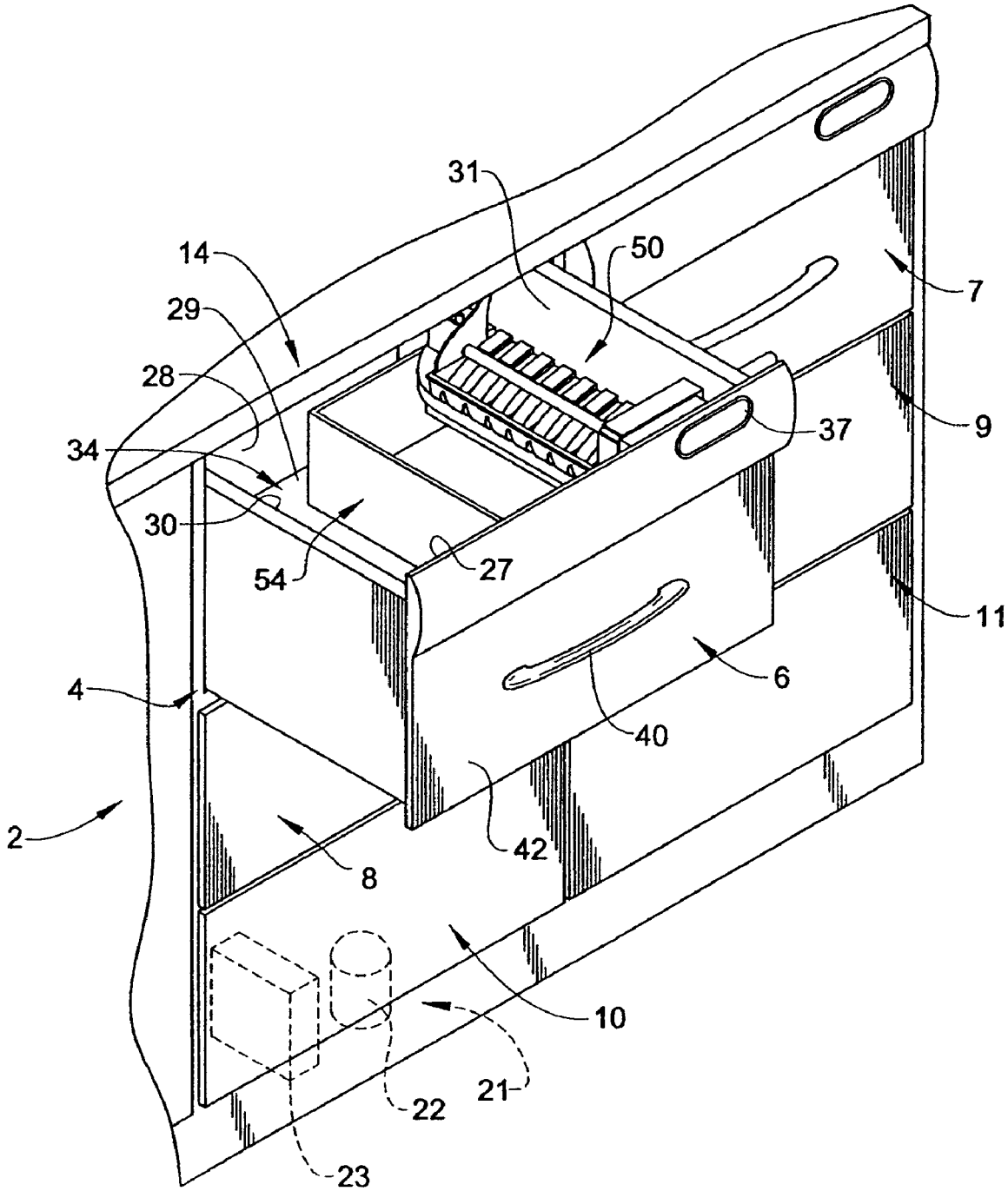
FIG. 1 is a partial perspective view of a refrigerated appliance including a drawer having arranged therein an icemaker constructed in accordance with the present invention.

With initial reference to FIG. 1, a refrigerated appliance, generally indicated as 2, includes a cabinet 4 having a plurality of drawers 6-11 that are arranged below a countertop 14 adjacent cabinetry (not shown). In accordance with the invention, drawers 6-11 can take on a variety of forms, such as fresh food compartments, wine compartments, freezer compartments and mechanical compartments. For example, drawer 10 is shown housing components of a refrigeration system 21 including a compressor 22 and a condenser 23. At this point, reference will be made to drawer 6 which is configured as an ice drawer as will be discussed more fully below. As shown, drawer 6 includes front, rear, bottom and opposing sidewalls 27-31 that collectively define a refrigerated compartment 34. Front wall 27 of drawer 6 includes a control panel 37 and a handle 40 exposed on a front face portion 42. Preferably, drawer 6 is provided with an icemaker 50 and an ice cube storage bin 54 for storing ice cubes produced by icemaker 50.

Figure 2:
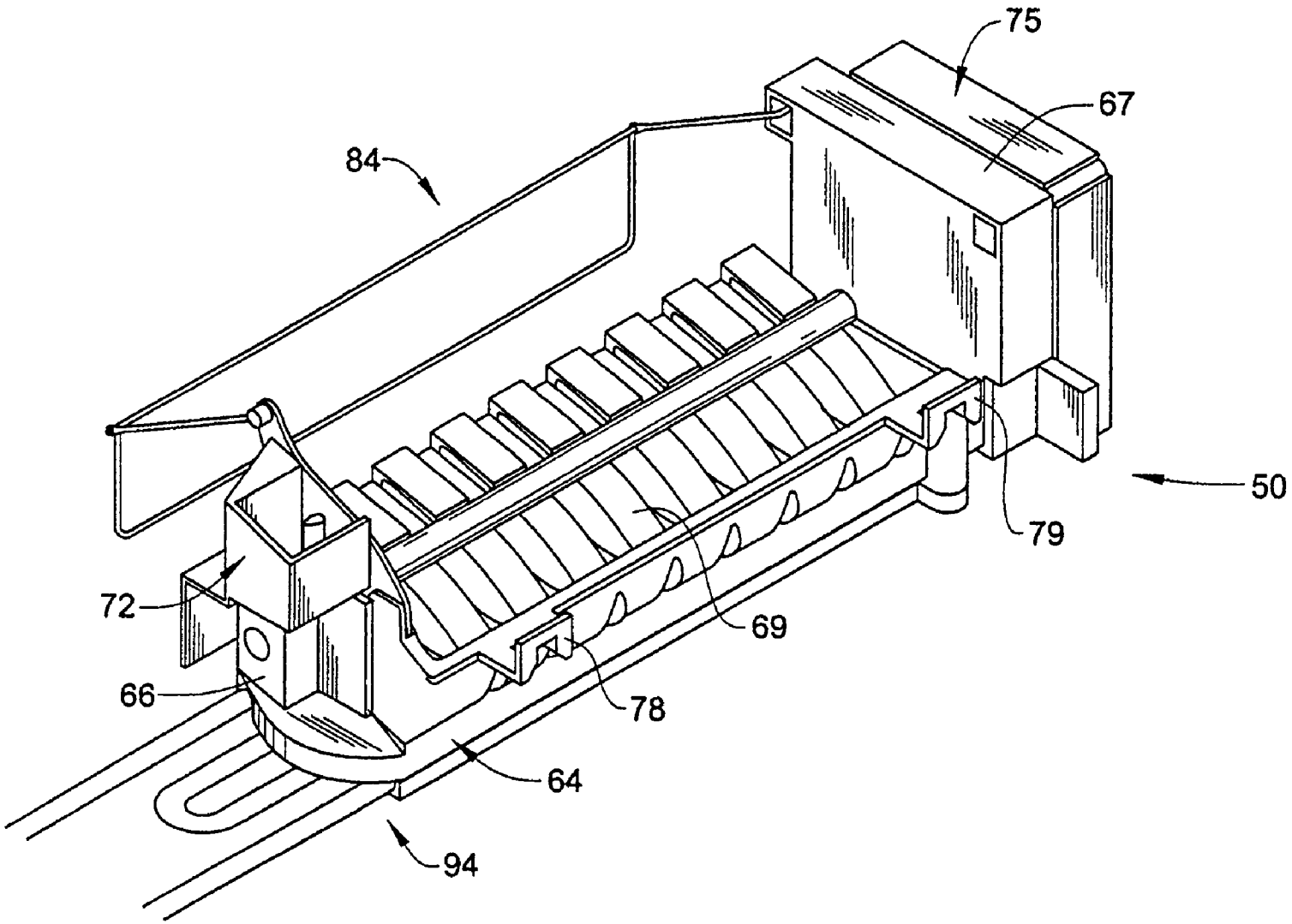
FIG. 2 is an upper perspective view of the icemaker of FIG. 1.

As best shown in FIG. 2, icemaker 50 includes a housing 64 having a first end portion 66 that leads to a second end portion 67 through an ice cube mold 69. Icemaker 50 includes a water inlet zone 72 arranged proximate to first end portion 66 and a motor housing 75 provided at second end portion 67. Motor housing 75 operates a plurality of lifter fingers (not separately labeled) that function to release ice cubes from ice mold 69 into ice cube storage bin 54 during an ejection process in a manner known in the art. Housing 64 is also provided with a pair mounting brackets 78 and 79 that enable icemaker 50 to be attached to one of the plurality of front, rear and opposing sidewalls 27, 28 and 30-31 respectively, of drawer 6. Finally, icemaker 50 is provided with a bail arm 84 that selectively activates icemaker 50 when a quantity of ice within ice cube storage bin 54 falls below a predetermined level in a manner also known in the art.

Figure 3:
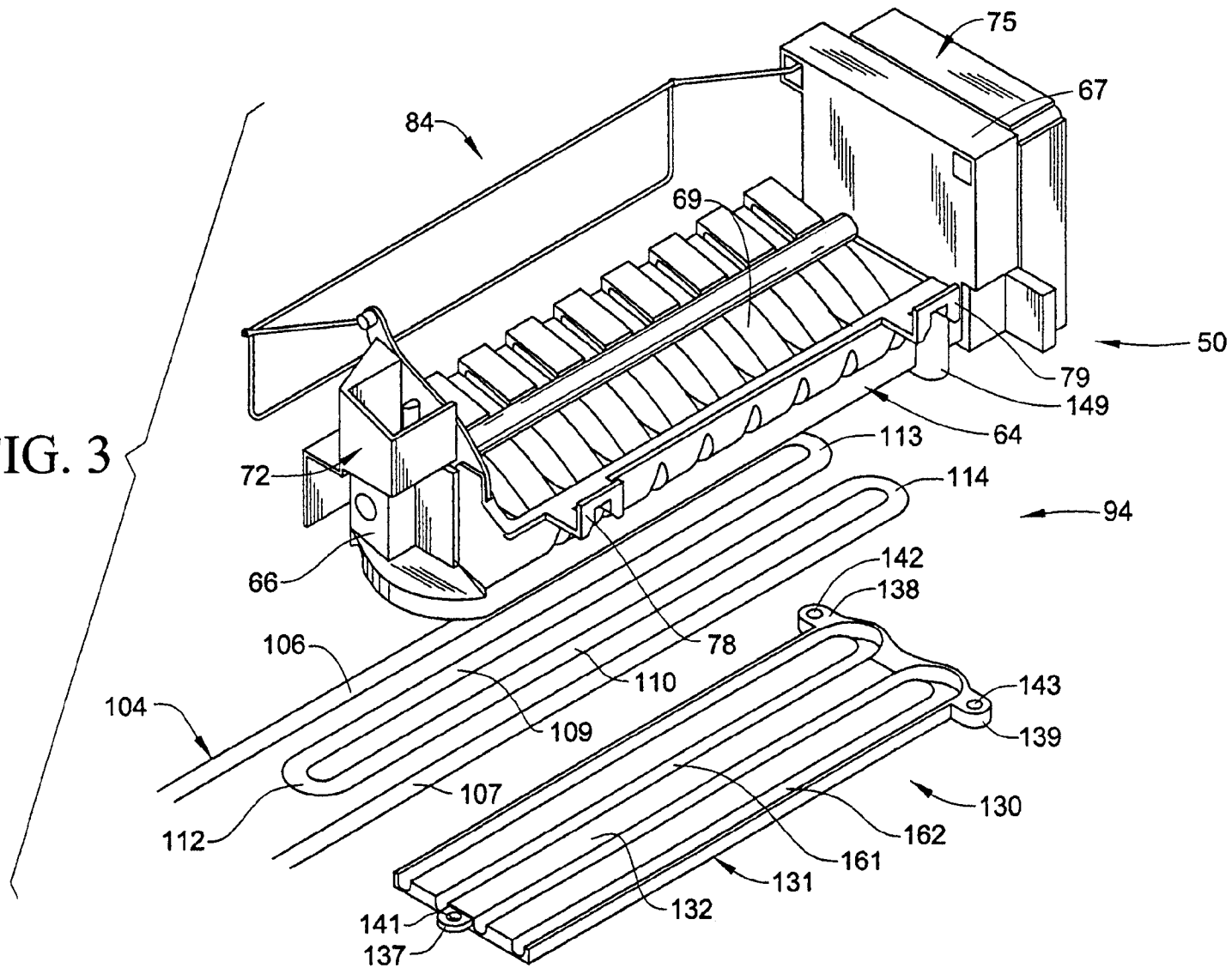
FIG. 3 is a partially exploded perspective view of the icemaker of FIG. 2.
Figure 4:
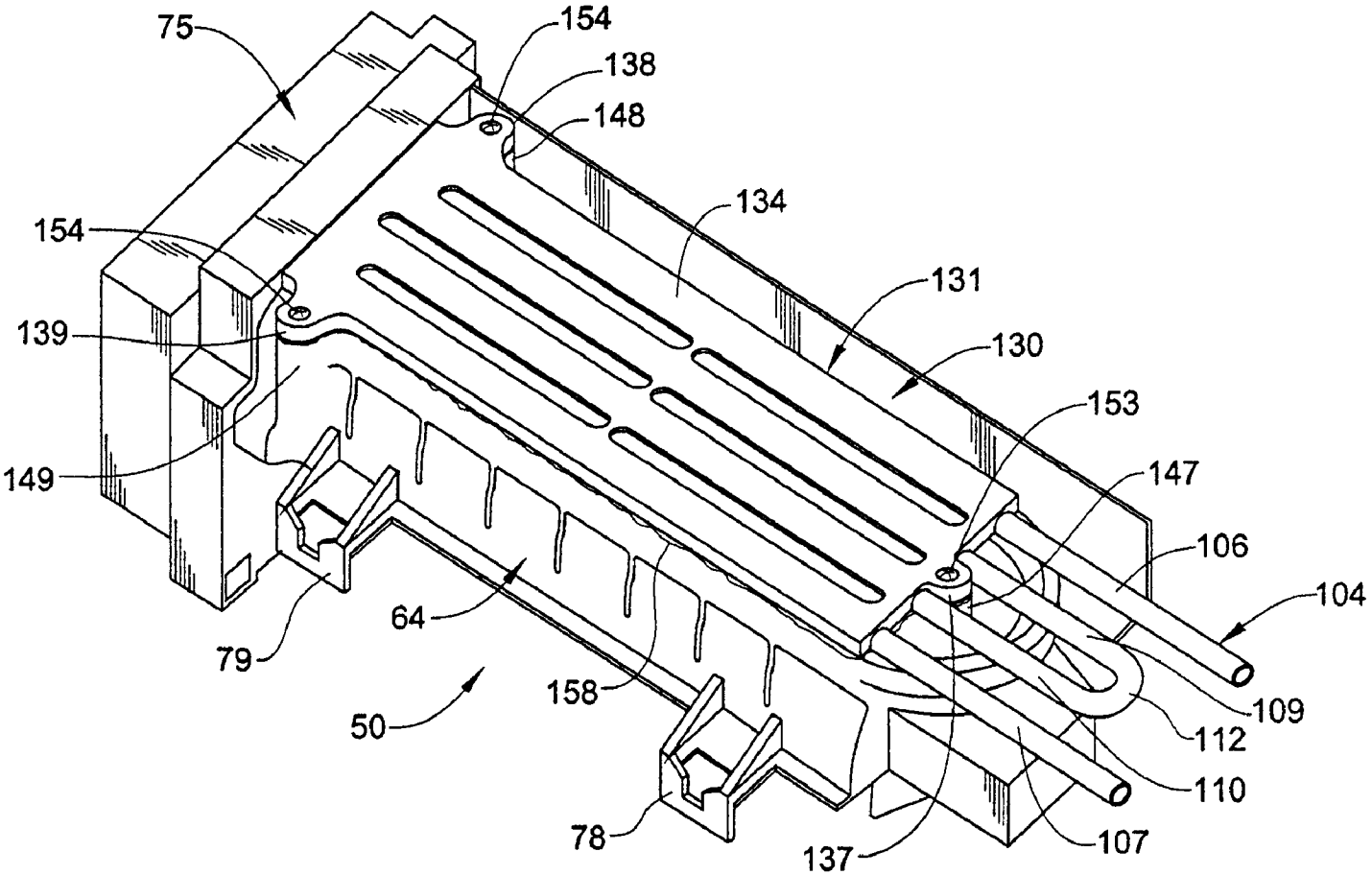
FIG. 4 is a lower perspective view of the icemaker of FIG. 2.

Reference will now be made to FIGS. 3 and 4 in describing a localized cooling system 94 for icemaker 50 constructed in accordance with the present invention. Cooling system 94 includes an evaporator shown taking the form of a coil 104 having first and second outer tubular portions 106 and 107, first and second inner tubular portions 109 and 110, and a plurality of interconnecting, curved portions 112-114. With this construction, evaporator coil 104 takes a serpentine-like form. Evaporator coil 104 is preferably secured to a mounting plate 130 having a main body portion 131 including a first surface 132 and a second, opposing surface 134 (FIG. 4). Main body portion 131 is provided with a plurality of mounting ears 137-139, each having an associated opening 141-143 that is configured to register with corresponding ones of a plurality of mounting lugs 147-149 provided on housing 64. Although various material could be employed, mounting plate 130 is preferably formed from aluminum.

Mounting plate 130 is preferably secured to housing 64 through a plurality of mechanical fasteners 153-155. Preferably, before mounting plate 130 is attached to housing 64, a thermally conductive paste 158 is applied between housing 64 and mounting plate 130. Thermally conductive paste 158 increases an energy transfer rate between evaporator coil 104 and ice cube mold 69 to facilitate the production of ice within icemaker 50. In further accordance with the invention, mounting plate 130 is provided with a first channel 161 having a generally U-shape, along with a second, juxtapose channel 162 also having a generally U-shape. Channels 161 and 162 combine to establish a serpentine-like form that is configured to receive evaporator coil 104. Most preferably, channels 161 and 162 snap-fittingly receives evaporator coil 104. By snap-fittingly receiving evaporator coil 104 in this manner, mounting plate 130 advantageously minimizes vibrations which may be transmitted from refrigeration system 21 to evaporator coil 104.

With this overall arrangement, refrigeration system 21 provides a refrigerant flow through evaporator coil 104 which is directly exposed to ice cube mold 69. Thus, when ice cube mold 69 is filled with water, evaporator coil 104 provides a cooling effect to form ice cubes. In addition to forming ice cubes which are subsequently dispensed into ice cube storage bin 54, evaporator coil 104 advantageously provides cooling for drawer 6. That is, instead of requiring additional refrigeration to cool drawer 6, evaporator coil 104 is selectively supplied with refrigerant from refrigeration system 21, regardless of a demand for ice in icemaker 50, to cool refrigerated compartment 34.

Preferably, the refrigerated temperature generated by evaporator coil 104 in refrigerated compartment 34 is well below 32° F. (0° C.) for the efficient production of ice cubes. Given the intimate contact with housing 64, evaporator coil 104 provides effective heat transfer for the rapid production of the ice cubes. In addition, the mounting arrangement for evaporation coil 104 provides for a compact system which enhances the available storage space in drawer 6. Although preferably used as a freezer compartment, depending on particular selections made by a user through control panel 37, evaporator coil 104 can also maintain compartment 34 at refrigerated temperatures above 32° F. (0° C.), thereby establishing a fresh food compartment, particularly when icemaking and storage is not needed. At this point, it should be readily understood that the present invention provides for a unique arrangement that not only provides localized cooling to an icemaker to facilitate the production of ice in an icemaker, but also provides cooling to an overall compartment regardless of a demand for ice sensed by the icemaker.

Although described with reference to a preferred embodiment of the invention, it should be readily understood that various changes and/or modifications can be made to the invention without departing from the spirit thereof. In general, the invention is only intended to be limited by the scope of the following claims.

What is claimed is:

1. A refrigerated appliance comprising:

a cabinet;

a drawer shiftably mounted in the cabinet, said drawer including front, rear, bottom and opposing side walls that collectively define a refrigerated compartment;

an icemaker unit mounted to one of the rear and opposing side walls of the drawer, said icemaker unit including a housing and an ice cube mold;

a refrigeration system including a compressor, a condenser and an evaporator; and a mounting plate attached to the housing and extending below the ice cube mold, with the evaporator being sandwiched between a portion of the housing and the mounting plate proximate to and below the ice cube mold, said refrigeration system being selectively operable to provide freezing temperatures to form ice cubes in the ice cube mold and establish refrigerated temperatures above 32° F. (0° C.) in the refrigerated compartment.

2. The refrigerated appliance according to claim 1, wherein the evaporator is interconnected to the mounting plate.

3. The refrigerated appliance according to claim 2, wherein the mounting plate includes at least one channel, said evaporator including a coil snap-fittingly received in the at least one channel.

4. The refrigerated appliance according to claim 3, wherein said at least one channel includes first and second, generally U-shaped channels, said evaporator coil extending, along a serpentine path, in each of the first and second channels of the mounting plate.

5. The refrigerated appliance according to claim 2, further comprising: a conductive paste provided between the mounting plate and the housing for increasing conduction between the evaporator coil and the ice cube mold.

6. The refrigerated appliance according to claim 1, wherein the mounting plate is formed from aluminum.

7. The refrigerated appliance according to claim 1, wherein the mounting plate is secured to the housing by a plurality of mechanical fasteners.

8. The refrigerated appliance according to claim 1, further comprising: an ice cube storage bin positioned in the drawer below the icemaker.

9. The refrigerated appliance according to claim 1, wherein the refrigerated temperatures generated by the evaporator in the drawer are below 32° F. (0° C.).

10. The refrigerated appliance according to claim 1, wherein the refrigerated temperatures generated by the evaporator in the drawer are above 32° F. (0° C.).

11. A method of refrigerating a drawer having front, rear, bottom, and opposing side walls that collectively define a refrigerated compartment comprising the steps of:

operating a refrigeration system including an evaporator coil sandwiched between a mounting plate extending below an ice cube mold and a portion of a housing supporting the ice cube mold of an icemaker mounted within the drawer and to one of the rear and opposing side walls of the drawer;

receiving an operator control input; and establishing a refrigerated temperature in the drawer through the evaporator based on the operator control input, said refrigerated temperature being selectively below or above freezing.

12. The method of claim 11, further comprising:

making ice cubes in the ice cube mold of the icemaker within the drawer; and storing the ice cubes in a storage bin provided in the drawer.

13. The method of claim 12 wherein the refrigerated temperature is established through the evaporator irrespective of the making of ice cubes.

* * * * *